US008770988B2

(12) United States Patent
Furukawa

(10) Patent No.: US 8,770,988 B2
(45) Date of Patent: Jul. 8, 2014

(54) CONNECTOR

(75) Inventor: Koji Furukawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/498,236

(22) PCT Filed: Oct. 5, 2010

(86) PCT No.: PCT/JP2010/067819

§ 371 (c)(1),
(2), (4) Date: Mar. 26, 2012

(87) PCT Pub. No.: WO2011/043488

PCT Pub. Date: Apr. 14, 2011

(65) Prior Publication Data

US 2012/0184142 A1 Jul. 19, 2012

(30) Foreign Application Priority Data

Oct. 5, 2009 (JP) ..... 2009-231829
Sep. 9, 2010 (JP) ..... 2010-201792

(51) Int. Cl.
*H01R 12/00* (2006.01)

(52) U.S. Cl.
USPC ..... 439/76.1; 439/606

(58) Field of Classification Search
USPC ..... 439/76.1, 606
See application file for complete search history.

(56) References Cited

U.S. PATENT DOCUMENTS 3,706,840 A * 12/1972 Moyle et al. ..... 174/524
4,542,260 A * 9/1985 Pearce ..... 174/524
4,701,999 A * 10/1987 Palmer ..... 29/827
4,822,550 A * 4/1989 Komathu ..... 264/263
4,843,520 A * 6/1989 Nakatani et al. ..... 361/739
4,868,638 A * 9/1989 Hirata et al. ..... 257/697
4,933,744 A * 6/1990 Segawa et al. ..... 257/795
5,009,311 A * 4/1991 Schenk ..... 206/706
5,108,955 A * 4/1992 Ishida et al. ..... 29/827

(Continued)

FOREIGN PATENT DOCUMENTS

DE 32 29 899 A1 2/1984
DE 10 2007 041 785 A1 3/2008
JP 2005-005168 A 1/2005
WO WO2008/074379 * 6/2008 ..... H01R 12/18

OTHER PUBLICATIONS

International Search Report (PCT/ISA/210) issued by the International Searching Authority in corresponding International Application No. PCT/JP2010/067819 on Dec. 30, 2010.

(Continued)

*Primary Examiner* — Ross Gushi
(74) *Attorney, Agent, or Firm* — Sughrue Mion, PLLC

(57) ABSTRACT

To provide a connector embedded with a substrate which can be fabricated with fewer working process at a lower cost.

A connector 10 includes a substrate 1 with an electronic component 3 mounted thereon, a terminal 4 which is electrically connected to the substrate 1, and a housing 5 comprised of synthetic resin and attached with the substrate 1 and the terminal 4. In addition, the electronic component 3 and the terminal 4 are electrically connected to the substrate 1 by reflow soldering using a lead-free solder 2. The connector 10 is fabricated by insert-molding the substrate 1 and the terminal 4 in the housing 5. Furthermore, the substrate 1 and the electronic component 3 are embedded in the synthetic resin of the housing 5.

1 Claim, 6 Drawing Sheets

(56) References Cited

U.S. PATENT DOCUMENTS

| | | | | |
|---|---|---|---|---|
| 5,120,231 | A * | 6/1992 | Masumoto | 439/76.1 |
| 5,132,877 | A * | 7/1992 | Branan et al. | 361/736 |
| 5,136,366 | A * | 8/1992 | Worp et al. | 257/687 |
| 5,319,522 | A * | 6/1994 | Mehta | 361/748 |
| 5,376,824 | A * | 12/1994 | Rauchmaul et al. | 257/666 |
| 5,394,304 | A * | 2/1995 | Jones | 361/765 |
| 5,406,027 | A * | 4/1995 | Matsumoto et al. | 174/546 |
| 5,554,821 | A * | 9/1996 | Patterson et al. | 174/541 |
| 5,577,937 | A * | 11/1996 | Itoh et al. | 439/620.22 |
| 5,586,388 | A * | 12/1996 | Hirao et al. | 29/830 |
| 5,617,297 | A * | 4/1997 | Lo et al. | 361/737 |
| 5,677,511 | A * | 10/1997 | Taylor et al. | 174/527 |
| 5,703,761 | A * | 12/1997 | Heiss | 361/800 |
| 5,739,463 | A * | 4/1998 | Diaz et al. | 174/378 |
| 5,773,895 | A * | 6/1998 | Hassan et al. | 257/774 |
| 5,774,342 | A * | 6/1998 | Brandenburg et al. | 361/774 |
| 5,909,915 | A * | 6/1999 | Okuda | 29/841 |
| 5,995,374 | A * | 11/1999 | Suzuki et al. | 361/767 |
| 6,034,421 | A * | 3/2000 | Tokunaga | 257/666 |
| 6,046,506 | A * | 4/2000 | Hikita et al. | 257/787 |
| 6,180,045 | B1 * | 1/2001 | Brandenburg et al. | 264/263 |
| 6,184,464 | B1 * | 2/2001 | Liptak et al. | 174/521 |
| 6,194,247 | B1 * | 2/2001 | Burns et al. | 438/107 |
| 6,282,092 | B1 * | 8/2001 | Okamoto et al. | 361/704 |
| 6,285,551 | B1 * | 9/2001 | Brandenburg et al. | 361/704 |
| 6,307,749 | B1 * | 10/2001 | Daanen et al. | 361/704 |
| 6,319,603 | B1 * | 11/2001 | Komiya et al. | 428/378 |
| 6,321,734 | B1 * | 11/2001 | Kaminaga et al. | 123/634 |
| 6,329,224 | B1 * | 12/2001 | Nguyen et al. | 438/127 |
| 6,340,791 | B1 * | 1/2002 | Stotz | 174/521 |
| 6,665,192 | B2 * | 12/2003 | Wimberger Friedl et al. | 361/752 |
| 6,680,435 | B1 * | 1/2004 | Ogawa et al. | 174/535 |
| 6,683,250 | B2 * | 1/2004 | Luettgen et al. | 174/544 |
| 6,779,260 | B1 * | 8/2004 | Brandenburg et al. | 29/841 |
| 6,974,727 | B2 * | 12/2005 | Iimura et al. | 438/125 |
| 6,975,024 | B2 * | 12/2005 | Koike et al. | 257/678 |
| 7,045,712 | B2 * | 5/2006 | Jaklin et al. | 174/521 |
| 7,049,510 | B2 * | 5/2006 | Neuhaeuser | 174/521 |
| 7,057,280 | B2 * | 6/2006 | Yee et al. | 257/730 |
| 7,132,746 | B2 * | 11/2006 | Brandenburg et al. | 257/713 |
| 7,134,194 | B2 * | 11/2006 | Brandenburg et al. | 29/832 |
| 7,146,721 | B2 * | 12/2006 | Hunkeler et al. | 29/841 |
| 7,151,674 | B2 * | 12/2006 | Sasaki et al. | 361/752 |
| 7,230,829 | B2 * | 6/2007 | Mandel et al. | 361/704 |
| 7,321,162 | B1 * | 1/2008 | Lee et al. | 257/676 |
| 7,359,212 | B2 * | 4/2008 | Mayuzumi et al. | 361/760 |
| 7,458,823 | B2 * | 12/2008 | Sugimoto et al. | 439/76.1 |
| 7,473,585 | B2 * | 1/2009 | Brandenburg et al. | 438/124 |
| 7,495,183 | B2 * | 2/2009 | Sugimoto et al. | 174/526 |
| 7,514,784 | B2 * | 4/2009 | Mayuzumi et al. | 257/712 |
| 7,566,836 | B2 * | 7/2009 | Tanner | 174/525 |
| 7,604,765 | B2 * | 10/2009 | Sugimoto et al. | 264/272.17 |
| 7,616,448 | B2 * | 11/2009 | Degenkolb et al. | 361/752 |
| 7,652,892 | B2 * | 1/2010 | Shiu et al. | 361/752 |
| 7,739,791 | B2 * | 6/2010 | Brandenburg et al. | 29/856 |
| 7,934,312 | B2 * | 5/2011 | Mayuzumi et al. | 29/841 |
| 7,972,146 | B2 * | 7/2011 | Busse | 439/78 |
| 8,071,895 | B2 * | 12/2011 | Shiu et al. | 174/521 |
| 8,218,297 | B2 * | 7/2012 | Nakamura et al. | 361/679.01 |
| 8,230,575 | B2 * | 7/2012 | Veenstra et al. | 29/592.1 |
| 8,310,833 | B2 * | 11/2012 | Sugimoto et al. | 361/737 |
| 8,367,204 | B2 * | 2/2013 | Uchida et al. | 428/375 |
| 8,379,395 | B2 * | 2/2013 | Wetzel | 361/748 |
| 8,410,377 | B2 * | 4/2013 | Yamaguchi et al. | 174/521 |
| 8,458,901 | B2 * | 6/2013 | Yamaguchi et al. | 29/841 |
| 2004/0008532 | A1 * | 1/2004 | Asawa | 363/147 |
| 2004/0182601 | A1 * | 9/2004 | Watanabe et al. | 174/256 |
| 2005/0000726 | A1 * | 1/2005 | Kimata et al. | 174/256 |
| 2005/0057902 | A1 * | 3/2005 | Sasaki et al. | 361/717 |
| 2005/0067177 | A1 * | 3/2005 | Saito et al. | 174/52.2 |
| 2005/0136852 | A1 * | 6/2005 | Nakagawa et al. | 455/90.3 |
| 2005/0263880 | A1 * | 12/2005 | Igarashi et al. | 257/723 |
| 2006/0012034 | A1 * | 1/2006 | Kadoya et al. | 257/712 |
| 2006/0065421 | A1 * | 3/2006 | Arai et al. | 174/52.2 |
| 2006/0077643 | A1 * | 4/2006 | Mayuzumi et al. | 361/753 |
| 2006/0134937 | A1 * | 6/2006 | Mayuzumi et al. | 439/61 |
| 2006/0171127 | A1 * | 8/2006 | Kadoya et al. | 361/752 |
| 2006/0252384 | A1 * | 11/2006 | Sugimoto et al. | 455/90.3 |
| 2006/0272150 | A1 * | 12/2006 | Eguchi et al. | 29/841 |
| 2006/0292751 | A1 * | 12/2006 | Brandenburg et al. | 438/122 |
| 2007/0066139 | A1 * | 3/2007 | Roeper et al. | 439/607 |
| 2007/0138697 | A1 * | 6/2007 | Takeda et al. | 264/278 |
| 2007/0161269 | A1 * | 7/2007 | Sugimoto et al. | 439/76.1 |
| 2007/0279877 | A1 * | 12/2007 | Dobritz et al. | 361/760 |
| 2008/0054384 | A1 | 3/2008 | Uematsu et al. | |
| 2009/0268414 | A1 * | 10/2009 | Lu | 361/736 |
| 2010/0151709 | A1 * | 6/2010 | Busse | 439/78 |
| 2012/0184142 | A1 * | 7/2012 | Furukawa | 439/620.22 |
| 2012/0196457 | A1 * | 8/2012 | Ikeda | 439/78 |
| 2013/0029502 | A1 * | 1/2013 | Brekosky et al. | 439/81 |
| 2013/0029503 | A1 * | 1/2013 | Brekosky et al. | 439/81 |
| 2013/0260579 | A1 * | 10/2013 | Yamanaka et al. | 439/83 |

OTHER PUBLICATIONS

Written Opinion (PCT/ISA/237) of the International Searching Authority issued in corresponding International Application No. PCT/JP2010/067819 on Dec. 30, 2010.

Communication dated Jan. 27, 2014 from the State Intellectual Property Office of P.R. China in a counterpart application No. 201080044702.X.

* cited by examiner

CONNECTOR

TECHNICAL FIELD

The present invention relates to a connector embedded with a substrate which is attached to an inside of a housing of the connector.

BACKGROUND ART

For example, as disclosed in PTL1, a connector in which a substrate is attached to an inside of a housing of the connector that is comprised of synthesis resin is known. Such a kind of connector embedded with the substrate is fabricated by inserting the substrate into the housing after the housing and the substrate are manufactured separately. In addition, the housing is provided therein with a crush rib which fixes the substrate by pressing and crushing at an edge of the substrate when the substrate is inserted.

CITATION LIST

Patent Literature
[PTL 1] JP-A-2005-005168

SUMMARY OF INVENTION

Technical Problem

However, in the connector embedded with the substrate according to the related art disclosed in PTL1 or the like, there is a problem in which since an attaching process of attaching the substrate to the inside of the housing is required, the manufacture cost is increased. In addition, there is another problem in which since the substrate is inserted and attached to the housing in such a manner that the crush rib is pressed and crushed, a large amount of stress is applied to the substrate when the substrate is inserted, and the stress is continuously applied to the substrate after the substrate is attached. Moreover, in the connector embedded with the substrate according to the related art, since a gap is formed between the housing and the substrate, waterproofing ability and durability may be deteriorated depending upon usage circumstances. In order to address the above drawback, the gap of the housing is sealed by resin, but the results in the material costs and the machining costs are required. In addition, in the connector embedded with the substrate according to the related art, a solder containing lead as a main component is used when electronic components or terminals are mounted on the substrate. It is not preferable to use the solder consisting of lead as a main component which is a substrate which is burden on the environment, from a point of view of environmental protection.

Solution to Problem

Accordingly, an object of the present invention is to provide a connector embedded with a substrate which can be fabricated with fewer working processes at a lower cost.

In order to achieve the above object, the invention set forth in a first aspect of the invention is a connector including a substrate on which an electronic component is mounted; a terminal which is electrically connected to the substrate; and a housing comprised of a synthetic resin, to which the substrate and the terminal are attached, wherein the substrate and the terminal are insert-molded in the housing.

In a second aspect of the invention, with regards to the connector of the first aspect of the invention, the terminal and the substrate are integrally provided.

In a third aspect of the invention, with regards to the connector of the first aspect of the invention, the housing is integrally provided with a terminal attaching portion that attaches a second terminal that is electrically connected to the substrate and other components.

In a fourth aspect of the invention, with regards to the connector of the first aspect of the invention, wherein the electrical component is electrically connected to the substrate by a lead-free solder.

In a fifth aspect of the invention, a connector comprises a substrate on which an electronic component is mounted; a terminal which is electrically connected to the substrate; and a housing comprised of a synthetic resin, to which the substrate and the terminal are attached; wherein the electronic component mounted on the substrate and a solder junction portion between the electronic component and the terminal are coated by a liquid curable resin, and the substrate and the terminal are insert-molded in the housing.

In a sixth aspect of the invention, with regards to the connector of the fifth aspect of the invention, a linear coefficient expansion of the liquid curable resin is intermediate between a linear coefficient expansion of a material constituting the substrate and a linear coefficient expansion of the synthetic material constituting the housing.

Advantageous Effects of Invention

According to the first aspect of the invention, since the substrate and the terminal are insert-molded in the housing, the connector embedded with the substrate can be provided where the process of attaching the substrate to the housing can be eliminated, thereby fabricating the connector with fewer working processes at a lower cost. In addition, it can provide the connector embedded with the substrate which can prevent stress from being applied to the substrate.

According to the second aspect of the invention, since the terminal is integrally provided with the substrate, the connector embedded with the substrate can be provided where the process of electrically connecting the terminal to the substrate can be eliminated, thereby fabricating the connector with fewer working processes at a lower cost.

According to the third aspect of the invention, since the housing is integrally provided with the terminal attaching portion attached with the second terminal which is electrically connected to the substrate and other component, the connector embedded with the substrate can be provided where space efficiency can be improved and the connector can be fabricated with fewer working processes at a lower cost.

According to the fourth aspect of the invention, since the electronic components are electrically connected to the substrate by the lead-free solder, the connector embedded with the substrate can be provided where there can be no burden on the environment and the connector can be fabricated with fewer working processes at a lower cost. In addition, since the melting point of the lead-free solder is higher than that of a solder containing lead as a main component, it is possible to prevent the lead-free solder from being re-molten by the heat of the synthetic resin in a molten state during the insert molding in which the substrate is inserted into the mold of the housing, thereby preventing the electronic components from being detached from the substrate.

According to the fifth aspect of the invention, in the connector including the substrate on which the electronic component is mounted, the terminal which is electrically connected to the substrate and the housing comprised of synthetic resin to which the substrate and the terminal are attached, the electronic component mounted on the substrate and the solder junction portion between the electronic component and the terminal are coated by the liquid curable resin, the substrate and the terminal are insert-molded in the housing. Since the process of assembling the substrate to the housing can be omitted, the connector embedded with substrate which can be manufactured by using fewer working processes with a low cost can be provided. In addition, it is possible to provide the connector embedded with the substrate which can prevent stress from being applied to the substrate. Furthermore, through the coating of the liquid curable resin which is an inexpensive process, the connector embedded with the substrate can be provided to cope with severe environments (e.g., temperature, humidity, vibration, high electrical potential, or the like) and have high reliability, waterproofing ability, and corrosion resistance.

According to the sixth aspect of the invention, since the linear coefficient expansion of the liquid curable resin is intermediate between the linear coefficient expansion of the material constituting the substrate and the linear coefficient expansion of the synthetic resin constituting the housing, the connector embedded with the substrate can be provided to alleviate the stress at thermal contraction which happens between the housing and the substrate when the connector is used under the severe environments and have high reliability, waterproofing, and corrosion resistance.

DESCRIPTION OF THE EMBODIMENTS (First Embodiment)

Figure 1:
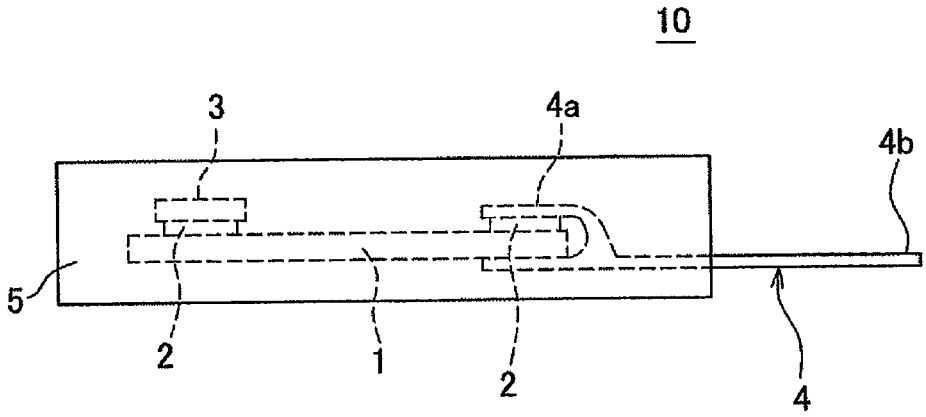
FIG. 1 is a view schematically illustrating the outline of a connector according to a first embodiment of the present invention.

Next, a connector according to a first embodiment of the present invention will be described with reference to FIGS. 1 to 7. A connector 10 of the present invention shown in FIG. 1 constitutes an active star coupler for relay of high-frequency communication. The connector 10 includes a substrate 1 with an electronic component 3 mounted on thereon, a terminal 4 which is electrically connected to the substrate 1, and a housing 5 comprised of synthetic resin and attached with the substrate 1 and the terminal 4.

The substrate 1 is a printed substrate of which a conductive circuit pattern is printed on a surface of the substrate comprised of an insulating synthetic resin.

The terminal 4 includes a pinching portion 4*a* comprised of a metal and pinching the substrate 1, and an opposite terminal connection portion 4*b* extending from the pinching portion 4*a* in a rod shape and electrically connected to the opposite terminal.

In addition, although one electronic component 3 and one terminal 4 are illustrated in FIG. 1, the connector 10 of the present invention includes a plurality of electronic components 3 and a plurality of terminals 4. Moreover, the directions of the opposite terminal connection portions 4*b* of the plurality of terminal 4 attached on the substrate 1 are arranged in order in the same direction. In the present invention, however, it is not necessary to arrange the directions of the opposite terminal connection portions 4*b* of the plurality of terminal 4 attached on the substrate 1 in order in the same direction.

In addition, each pinch portion 4*a* of the plurality of terminals 4 and the plurality of electronic components 3 are electrically connected to the circuit pattern of the substrate 1 by reflow soldering using a lead-free solder 2. Moreover, the lead-free solder 2 is a solder which does not use lead that is a substance which is a burden on the environment.

The housing 5 is comprised of thermoplastic resin, and is obtained by injection molding. In addition, according to the connector 10 of the present invention, the substrate 1, on which the electric component 3 is mounted and to which the terminal 4 is electrically connected, is fabricated by insert-molding in the housing 5. Furthermore, the substrate 1 and the electronic component 3 are embedded in the synthetic resin of the housing 5, and for the terminal 4, the pinch portion 4*a* is embedded in the synthetic resin of the housing 5, and the opposite terminal connection portion 4*b* protrudes outwardly from the housing 5.

Figure 2:
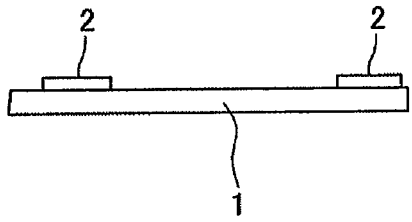
FIG. 2 is a view explaining a method of fabricating the connector shown in FIG. 1 to illustrate the state in which a lead-free solder is applied on a substrate.

Next, a method of fabricating the connector 10 of the above-mentioned configuration will be described. First, as shown in FIG. 2, the lead-free solder 2 in cream form is applied on connection portions between the circuit pattern of the substrate 1 and the electronic component 3 and the terminal 4 by a dispenser. In addition, in the present invention, the lead-free solder 2 may be screen-printed on the substrate 1.

Figure 3:
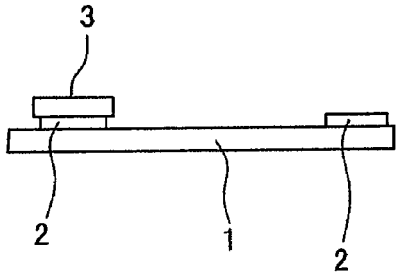
FIG. 3 is a view explaining a method of fabricating the connector shown in FIG. 1 to illustrate the state in which an electronic component is set on the substrate shown in FIG. 2.

Then, as shown in FIG. 3, the electronic component 3 is set at the portion of the substrate 1, on which the lead-free solder 2 is applied, by a mounter. That is, temporary fitting is performed.

Figure 4:
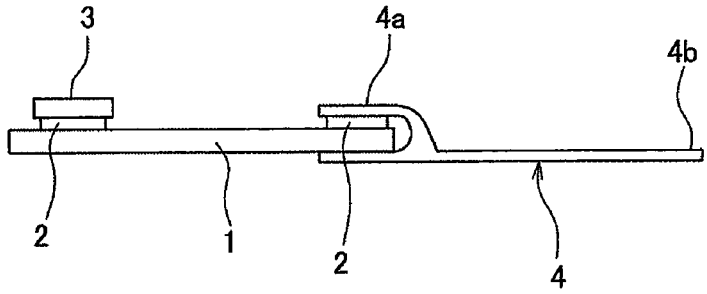
FIG. 4 is a view explaining a method of fabricating the connector shown in FIG. 1 to illustrate the state in which a terminal is set on the substrate shown in FIG. 3.

And then, as shown in FIG. 4, the terminal 4 is set by pinching the portion of the substrate 1, on which the lead-free solder 2 is applied, with the pinching portion 4*a* of the terminal 4. That is, temporary fitting is performed. In this instance, the lead-free solder 2 may be supplemented, if necessary.

Figure 5:
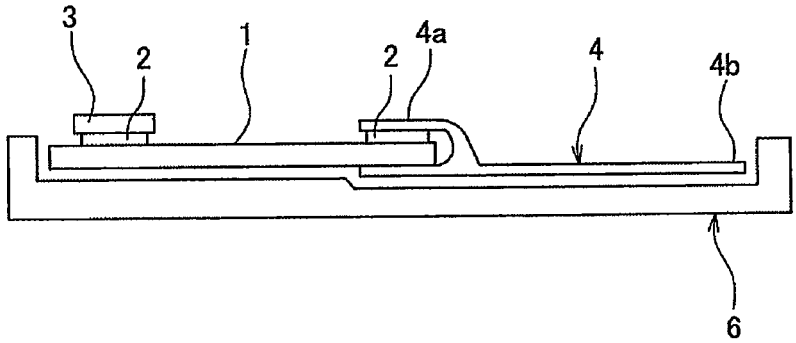
FIG. 5 is a view explaining a method of fabricating the connector shown in FIG. 1 to illustrate the state in which the substrate shown in FIG. 4 is set on a positioning reflow jig.

Then, as shown in FIG. 5, the substrate 1 which is set with the electronic component 3 and the terminal 4 is set on the positioning reflow jig 6 to position the terminal 4 and the substrate 1. The substrate 1 is introduced into a reflow furnace for every positioning reflow jig 6, and the lead-free solder 2 which is molten by heating is cured to electrically connect the electronic component 3 and the terminal 4 with the circuit pattern of the substrate 1 and simultaneously fix them on the substrate 1 withdrawn from the positioning reflow jig 6 may be introduced individually into the reflow furnace.

Figure 6:
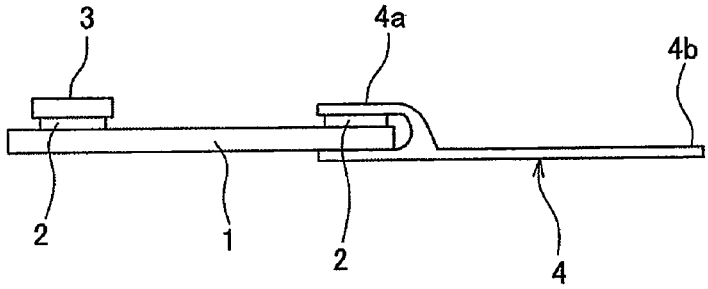
FIG. 6 is a view explaining a method of fabricating the connector shown in FIG. 1 to illustrate the state in which an electronic component and a terminal are set on the substrate shown in FIG. 5 by reflow soldering.
Figure 7:
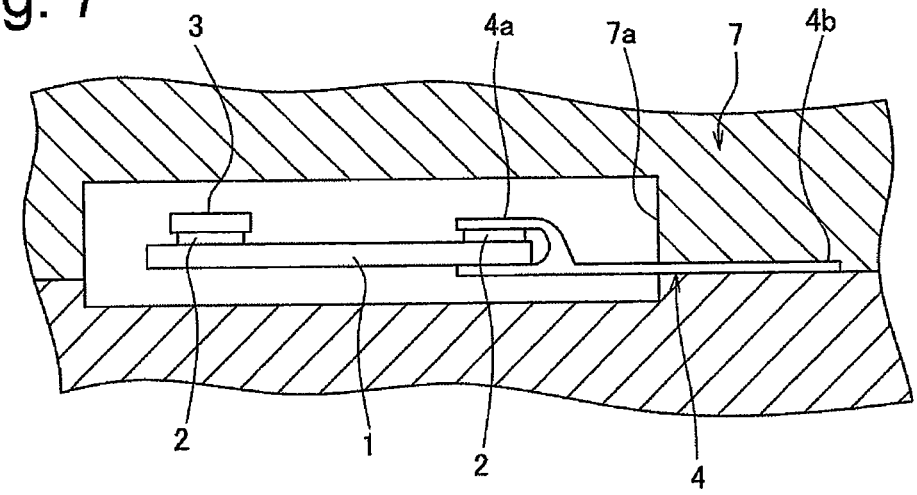
FIG. 7 is a view explaining a method of fabricating the connector shown in FIG. 1 to illustrate the state in which the substrate shown in FIG. 6 is set in an inside of an injection molding mold of a housing.

And then, the substrate 1 shown in FIG. 6, on which the electric component 3 is mounted and to which the terminal 4 is electrically connected, is set in a cavity 7*a* of the injection molding mold 7 of the housing 5, as the position shown in FIG. 7, and the synthetic resin in a molten state is injected into the cavity 7*a* to form the housing 5. That is, the substrate 1, the electronic component 3, and the terminal 4 are insert-molded in the housing 5. The connector 10 shown in FIG. 1 is fabricated by the above process.

As such, the connector 10 of the present invention can eliminate the process of attaching the substrate 1 to the housing 5, thereby fabricating the connector with fewer working processes at a lower cost. In addition, since it is not necessary to attach the substrate 1 to the housing 5, the connector 10 of the present invention can prevent the stress from being applied to the substrate 1. Moreover, since the substrate 1 and the electronic component 3 mounted on the substrate 1 are embedded in the synthetic resin of the housing 5, the connector 10 of the present invention can improve the waterproofing, dustproofing and vibration-resistance for the substrate 1 and the electronic component 3.

According to the connector 10 of the present invention, since the electronic component 3 and the terminal 4 are attached to the substrate 1 by using the lead-free solder 2 having a melting point higher than that of a solder containing lead as a main component, it is possible to prevent the lead-free solder 2 from being re-molten by the heat of the synthetic resin in a molten state when the substrate 1, the electronic component 3 and the terminal 4 are insert-molded in the housing 5, thereby preventing the electronic component 3 and the terminal 4 from being detached from the substrate 1.

In this embodiment, as "the lead-free solder 2", a solder, with no lead, comprised of an alloy having a composition consisting of Ag (silver) of 3.0 wt %, Cu (copper) of 0.5 wt %, and the remainder of Sn (tin), is used. The melting point of the solder is about 220° C. In addition, in this embodiment, as the "thermoplastic resin constituting the housing 5", PP (polypropylene) is used. At the time of the injection molding, the temperature of PP which is injected into the cavity 7*a* of the injection molding mold 7 is about 185° C. to about 200° C.

In the present invention, as well as PP mentioned above, as the "thermoplastic resin constituting the housing 5", PBT (polybutylene terephthalate) and the like may be used other than PP described above. At the time of the injection molding, the temperature of PBT which is injected into the cavity 7*a* of the injection molding mold 7 is about 250° C. to 265° C. In this instance, as the "lead-free solder 2", it is preferable to use a solder having a higher melting point than 265° C. More specifically, it is preferable to use a solder, with no lead, containing the alloy having the composition consisting of Ag (silver) of 3.0 wt %, Cu (copper) of 0.5 wt %, and the remainder of Sn (tin), and copper powder or multi-component metal particles. Above this, in the case where PBT is used as the "thermoplastic resin constituting the housing 5", the electronic component 3 and the terminal 4 are soldered onto the substrate 1 by the above-mentioned lead-free solder 2 containing the alloy having the composition consisting of Ag (silver) of 3.0 wt %, Cu (copper) of 0.5 wt %, and the remainder of Sn (tin), and then the surface of the lead-free solder 2 is coated with epoxy resin, thereby preventing the heat of the PBT in a molten state from being transferred to the lead-free solder 2 at the time of the injection molding of the housing 5 and to prevent re-melting of the lead-free solder 2.

In addition, according to the present invention, in a case where a glass epoxy substrate is used as the "substrate 1" and the PBT is used as the "thermoplastic resin constituting the housing 5", it is more preferable to use the PBT material containing glass fiber of about 30 wt %. The coefficient of thermal expansion of the substrate 1 can be made to be equal to that of the housing 5 in this manner, thereby preventing the housing 5 from being deformed or cracked due to thermal variation.

(Second Embodiment)

Next, a connector according to a second embodiment of the present invention will be described with reference to FIGS. 8 to 10. In addition, in FIGS. 8 to 10, like parts are indicated by the same reference numerals as the parts in the first embodiment, and the description thereof will be omitted.

Figure 8:
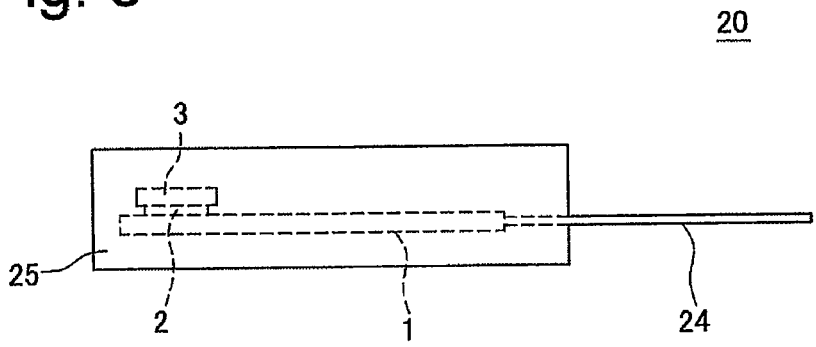
FIG. 8 is a view schematically illustrating the outline of a connector according to a second embodiment of the present invention.
Figure 9:
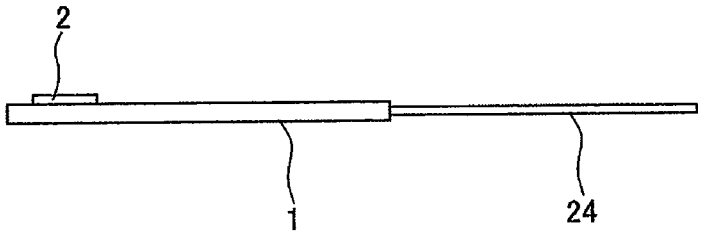
FIG. 9 is a view explaining a method of fabricating the connector shown in FIG. 8 to illustrate the state in which a lead-free solder is applied on a substrate of a terminal integral type.

A connector 20 of the present invention shown in FIG. 8 includes a substrate 1 with an electronic component 3 mounted thereon, a terminal 24 integrally provided on the substrate 1, and a housing 25 comprised of synthetic resin and attached with the substrate 1 and the terminal 24.

The terminal 24 is integrally provided on the substrate 1 by covering the protruding portion protruding from an outer edge of the substrate 1 in a rod shape, that is, the surface of the synthetic resin portion, by a metal foil. In addition, the metal foil comes into contact with the circuit pattern of the substrate 1, and is electrically connected to the circuit pattern.

In FIG. 8, although one electronic component 3 and one terminal 24 are illustrated in FIG. 8, the connector 20 of the present invention includes a plurality of electronic components 3 and a plurality of terminals 24.

In addition, the plurality of electronic components 3 are electrically connected to the circuit pattern of the substrate 1 by reflow soldering using a lead-free solder 2.

The housing 25 is comprised of thermoplastic resin, and is obtained by injection molding. In addition, according to the connector 20 of the present invention, the substrate 1, on which the electric component 3 is mounted and the terminal 24 is integrally provided, is fabricated by insert-molding in the housing 25. Furthermore, the substrate 1 and the electronic component 3 are embedded in the synthetic resin of the housing 25, and the terminal 24 is installed in such a manner that a distal end portion toward the substrate 1 is embedded in the synthetic resin of the housing 25, and a proximal end portion spaced away from the substrate 1 protrudes outwardly from the housing 25.

Next, a method of fabricating the connector 20 of the above-mentioned configuration will be described. First, as shown in FIG. 9, the lead-free solder 2 in cream form is applied on a connection portion between the circuit pattern of the substrate 1, on which the terminal 24 is integrally provided, and the electronic component 3 by a dispenser.

Figure 10:
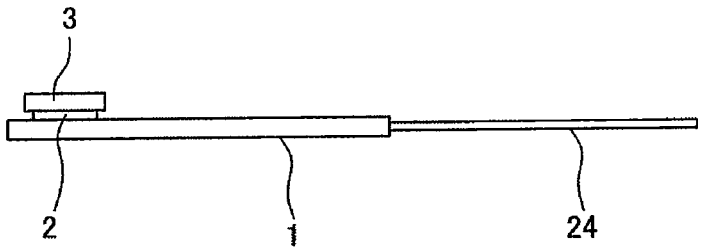
FIG. 10 is a view explaining a method of fabricating the connector shown in FIG. 8 to illustrate the state in which an electronic component is set on the substrate of a terminal integral type shown in FIG. 9.

Then, as shown in FIG. 10, the electronic component 3 is set at the portion of the substrate 1, on which the lead-free solder 2 is applied, by a mounter. That is, temporary fitting is performed.

Then, the substrate 1 set with the electronic component 3 is introduced into a reflow furnace, and the lead-free solder 2 which is molten by heating is cured to electrically connect the electronic component 3 with the circuit pattern of the substrate 1 and simultaneously fix them at the substrate 1.

And then, the substrate 1, on which the electric component 3 is mounted, is set in a cavity of the injection molding mold of the housing 25, and the synthetic resin in a molten state is injected into the cavity to form the housing 25. That is, the substrate 1, the electronic component 3, and the terminal 24 are insert-molded in the housing 25. The connector 20 shown in FIG. 8 is fabricated by the above process.

As such, since the terminal 24 is integrally provided on the substrate 1, the connector 20 of the present invention can eliminate the process of electrically connecting the terminal 24 with the circuit pattern of the substrate 1, thereby fabricating the connector with fewer working processes at a lower cost.

(Third Embodiment)

Next, a connector according to a third embodiment of the present invention will be described with reference to FIG. 11. In addition, in FIG. 11, like parts are indicated by the same reference numerals as the parts in the first and second embodiments, and the description thereof will be omitted.

Figure 11:
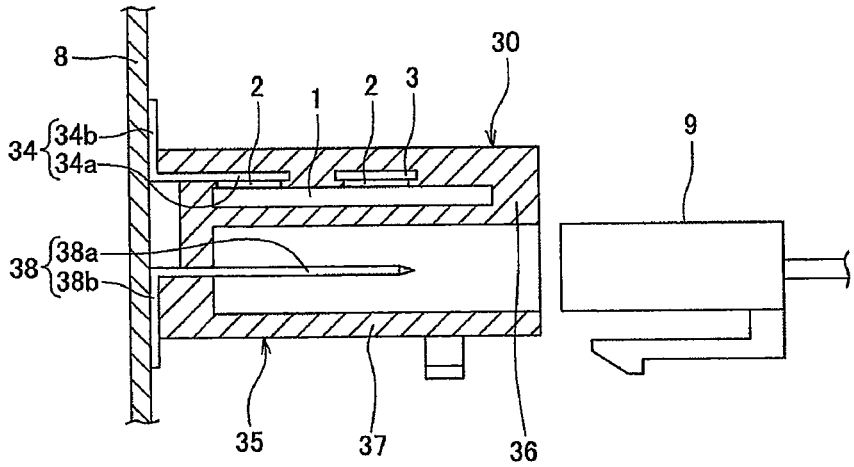
FIG. 11 is a view schematically illustrating the outline of a connector according to a third embodiment of the present invention.

A connector 30 shown in FIG. 11 is a connector which is electrically connected to an FPC (flexible printed substrate) 8. The connector 30 includes a substrate 1 with an electronic component 3 mounted thereon, a terminal 34 which is electrically connected to the substrate 1, a second terminal 38, and a housing 35 comprised of synthetic resin and integrally provided with a substrate attaching portion 36, to which the substrate 1 and the terminal 34 are attached, and a terminal attaching portion 37, to which the second terminal 38 is attached.

The terminal 34 includes a substrate connection portion 34*a* of a rod shape comprised of metal and electrically connected to the substrate 1, and an FPC connection portion 34*b* extending in a rod shape from the end portion of the substrate connection portion 34*a* toward the substrate connection portion 34*a* at a right angle and electrically connected to the FPC 8. In addition, the terminal 34 is formed in an L-shape.

In addition, although one electronic component 3 and one terminal 34 are illustrated in FIG. 11, the connector 30 of the present invention includes a plurality of electronic components 3 and a plurality of terminals 34.

In addition, each substrate connection portion 34*a* of the plurality of terminals 34 and the plurality of electronic components 3 are electrically connected to the circuit pattern of the substrate 1 by reflow soldering using a lead-free solder 2.

The second terminal 38 includes an opposite connector connection portion 38*a* of a rod shape comprised of metal and electrically connected to an opposite connector 9 which is installed on a substrate different from the substrate 1, and an FPC connection portion 38*b* extending in a rod shape from a end portion of the opposite connector connection portion 38*a* toward the opposite connector connection portion 38*a* at a right angle and electrically connected to the FPC 8. In addition, the second terminal 38 is formed in an L-shape.

The housing 35 is comprised of thermoplastic resin, and is obtained by injection molding. In addition, according to the connector 30 of the present invention, the substrate 1, on which the electric component 3 is mounted and to which the terminal 34 is electrically connected, and the second terminal 38 are insert-molded in the housing 35.

The substrate 1 and the electronic component 3 are embedded in the substrate attaching portion 36 of the housing 35, that is, are embedded in the synthetic resin. The terminal 34 is set in such a manner that the substrate connection portion 34*a* is embedded in the substrate attaching portion 36, that is, in the synthetic resin, and the FPC connection portion 34*b* protrudes outwardly from the substrate attaching portion 36, that is, the housing 35.

In addition, the terminal attaching portion 37 of the housing 35 is arranged in parallel with the substrate attaching portion 36, and is formed in the shape of a barrel with a bottom portion to receive the opposite connector 9. Furthermore, the second terminal 38 is set in such a manner that the opposite connector connection portion 38*a* is positioned in an inner space of the terminal attaching portion 37, and the FPC connection portion 38*b* protrudes outwardly from the terminal attaching portion 37, that is, the housing 35.

The connector 30 of the above-mentioned configuration will be fabricated by the following process. First, by the reflow soldering using the lead-free solder 2, the substrate connection portion 34*a* of the terminal 34 and the electronic component 3 are electrically connected to the circuit pattern of the substrate 1, and are simultaneously fixed to the substrate 1. Next, the substrate 1, on which the electric component 3 is mounted and to which the terminal 34 is electrically connected, and the second terminal 38 are set in a cavity of the injection molding mold of the housing 35, and the synthetic resin in a molten state is injected into the cavity to form the housing 35. That is, the substrate 1, the electronic component 3, the terminal 34, and the second terminal 38 are insert-molded in the housing 35. The connector 30 shown in FIG. 11 is fabricated by the above process. After that, the connector 30 is electrically connected to the FPC 8.

As such, the connector 30 of the present invention can eliminate the process of attaching the substrate 1 and the second terminal 38 to the housing 35, thereby fabricating the connector with fewer working processes without at a lower cost. In addition, since the housing 35 is integrally provided with the substrate attaching portion 36, to which the substrate 1 and the terminal 34 are attached, and the terminal attaching portion 37, to which the second terminal 38 is attached, it is possible to improve a space efficiency of an electrical parts which are mounted on the connector 30 of the present invention.

(Fourth Embodiment)

Figure 12:
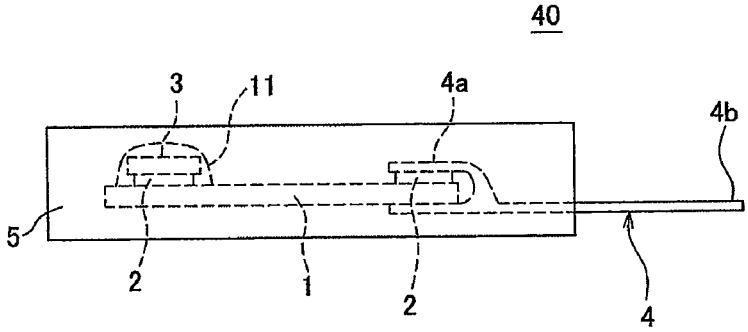
FIG. 12 is a diagram schematically illustrating a connector according a fourth embodiment of the present invention.
Figure 13:
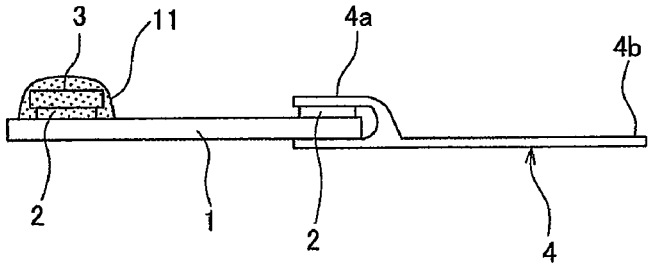
FIG. 13 is a diagram illustrating a method of manufacturing the connector shown in FIG. 12 to show a state in which an electronic component mounted on a substrate and a solder junction portion between the electronic component and the substrate are coated by liquid curable resin.

Next, the connector according to the fourth embodiment of the present invention will now be described with reference to FIGS. 12 and 13. In FIGS. 12 and 13, like parts are indicated by the same reference numerals as the parts in the first embodiment, and the description thereof will be omitted.

A connector 40 of the present invention shown in FIG. 12 is substantially identical to the above-described connector 10 according to the first embodiment, except that after the electronic component 3 mounted on the substrate 1 and the solder junction portion between the electronic component 3 and the substrate 1 are coated by a liquid curable resin 11, the substrate 1 and the terminal 4 are insert-molded in the housing 5. In addition, reference numeral 2 designates lead-free solder.

The liquid curable resin 11 is epoxy-based thermosetting resin that is generally called "under-fill". In addition, the liquid curable resin 11 has a linear coefficient expansion which is higher than that of the synthetic resin constituting the substrate 1 and lower than that of the synthetic resin constituting the housing 5.

In the present invention, it is preferable that the linear coefficient expansion of the "liquid curable resin 11" is intermediate between the linear coefficient expansion of the material constituting the substrate 1 and the linear coefficient expansion of the synthetic material constituting the housing 5. More preferably, the linear coefficient expansion of the "liquid curable resin 11" is approximately the average of the linear coefficient expansion of the material that constitutes the substrate 1 and the linear coefficient expansion of the synthetic material constituting the housing 5. By using the liquid curable resin 11, it is possible to alleviate the stress during thermal contraction which happens between the housing 5 and the substrate 5 when the connector 40 is used in severe environments and to improve reliability, waterproofing, and corrosion resistance. Furthermore, in the present invention, even in the case where the linear coefficient expansion of the "liquid curable resin 11" is not intermediate between the linear coefficient expansion of the material constituting the substrate 1 and the linear coefficient expansion of the synthetic resin constituting the housing 5, since it can cope with humidity and vibration, it is possible to improve reliability, waterproofing, and corrosion resistance.

The connector 40 having the above-described configuration is manufactured as below. First, in the same manner as the connector 10 according to the first embodiment, the electronic component 3 and the terminal 4 are electrically connected to the circular pattern of the substrate 1 and fixed to the substrate 1 by the reflow soldering using the lead-free solder 2. Next, as shown in FIG. 13, the liquid curable resin 11 is applied on the electronic component 3 mounted on the substrate 1, and the solder junction portion between the electronic component 3 and the substrate 1 by a dispenser or the like. After that, the substrate applied with the liquid curable resin 11 is placed in a drying oven for a predetermined time to cure the liquid curable resin 11. In this way, the electronic component 3 mounted on the substrate 1, and the solder junction portion between the electronic component 3 and the substrate 1 are coated by the liquid curable resin 11. Then, the substrate 1 is set in a cavity of an injection molding mold for the housing 5, and synthetic resin of a molten state is injected into the cavity to form the housing 5. That is, the substrate 1, the electronic component 3 and the terminal 4 are insert-molded in the housing 5. As a result, the connector 40 shown in FIG. 12 is manufactured.

In this manner, in the connector 40 according to the present invention, after the electronic component 3 mounted on the substrate 1 and the solder junction portion between the electronic component 3 and the substrate 1 are coated by the liquid curable resin 11, the substrate 1 and the terminal 4 are insert-molded in the housing 5. Therefore, it is possible to cope with severe environments (e.g., temperature, humidity, vibration, high electrical potential, or the like) and improve the reliability, waterproofing ability, and corrosion resistance with an inexpensive process, as compared with the above-described connectors 10, 20 and 30.

Further, in the present invention, as the "liquid curable resin 11", it is possible to use a polyolefin-based or an acryl-based coating material which is used as a damp-proof agent of the substrate, as well as the above-described epoxy-based thermosetting resin. In this instance, the above-described process of placing the substrate 1 into the drying oven can be omitted.

In addition, although the housing 35 is provided with the terminal attaching portion 37 attached with the second terminal 38 which connects the connector 9 installed on the substrate and the FPC 8 in this embodiment, the second terminal may be configured in such a manner that a wire and a wire are connected to each other in the present invention. That is, the second terminal may be attached to the distal end of the wire, and the connection opponent of the second terminal may be a connector attached to the distal end of the wire.

In addition, the electronic component 3 and the terminals 4 and 34 are attached to the substrate 1 by the reflow soldering using the lead-free solder 2 in the above-mentioned embodiments, but the present invention is not limited thereto. They may be attached by using a conductive adhesive or supersonic welding.

In this instance, the above-mentioned embodiments are merely typical forms of the present invention, and the present invention is not limited thereto. That is, the present invention can be variously modified within the claimed scope without changing the gist of the present invention.

The present application is based on Japanese Patent Application No. 2009-231829 filed on Oct. 5, 2009 and Japanese Patent Application No. 2010-201792 filed on Sep. 9, 2010, the contents of which are incorporated herein for reference.

REFERENCE SIGNS LIST

1: substrate
2: lead-free solder
3: electronic component
4, 24, 34: terminal
5, 25, 35: housing
37: terminal attaching portion
38: second terminal
10, 20, 30, 40: connector

The invention claimed is:

1. A connector comprising:

a substrate on which an electronic component is mounted;

a terminal which is electrically connected to the substrate; and a housing comprised of a synthetic resin, to which the substrate and the terminal are attached;

wherein the electronic component mounted on the substrate and a solder junction portion between the electronic component and the terminal are coated by a liquid curable resin, and the substrate and the terminal are insert-molded in the housing, wherein a linear coefficient expansion of the liquid curable resin is intermediate between a linear coefficient expansion of a material constituting the substrate and a linear coefficient expansion of the synthetic material constituting the housing.

* * * * *